US008596169B2

(12) United States Patent
Wang

(10) Patent No.: US 8,596,169 B2
(45) Date of Patent: Dec. 3, 2013

(54) RATCHET WRENCH

(76) Inventor: Yao-Hung Wang, Taichung (TW)

( * ) Notice: Subject to any disclaimer, the term of this patent is extended or adjusted under 35 U.S.C. 154(b) by 178 days.

(21) Appl. No.: 12/944,028

(22) Filed: Nov. 11, 2010

(65) Prior Publication Data

US 2012/0118112 A1 May 17, 2012

(51) Int. Cl.
*B25B 13/46* (2006.01)

(52) U.S. Cl.
USPC ..... 81/60; 81/58.1

(58) Field of Classification Search
USPC ..... 81/60, 58, 58.1, 58.3, 58.4, 58.5, 59.1, 81/177.8
See application file for complete search history.

(56) References Cited

U.S. PATENT DOCUMENTS 233,507 A * 10/1880 Hiatt ..... 81/58.4
561,823 A * 6/1896 Sahfer ..... 81/58.1
3,009,372 A * 11/1961 Kostka ..... 81/58.4
4,406,186 A * 9/1983 Gummow ..... 81/60
7,278,338 B2 * 10/2007 Chen ..... 81/58

* cited by examiner

*Primary Examiner* — Hadi Shakeri

(57) ABSTRACT

A ratchet wrench contains a handle and a head member, wherein the wrench head includes a receiving portion to receive a rotating member and a hole, the hole includes a plurality of teeth arranged around an inner peripheral side thereof, the receiving portion includes a groove disposed on a rear end thereof, the groove includes a through orifice fixed on a bottom end thereof, the through orifice includes a wider recess formed on a bottom end thereof; a limiting device secured in the through orifice and includes a retaining block fixed in the groove, and the retaining block includes a post extending downward from a bottom end thereof, the post includes a notch disposed on a middle section thereof to receive a spring, and the spring includes a sleeve fitted thereon, the post includes an annular slot formed adjacent to a bottom end thereof to retain with a C-shaped retainer.

4 Claims, 6 Drawing Sheets

RATCHET WRENCH

BACKGROUND OF THE INVENTION

1. Field of the Invention

The present invention relates to a ratchet wrench that is additionally provided with a limiting device so that a head member rotates and to be shift its limiting state.

2. Description of the Prior Art

A conventional socket wrench includes ratchet and fixed type of wrenches, wherein the fixed socket wrench has to be rotated by rotating and changing an angle between a nut (bolt) and the wrench during operation, thus the user has to change operating postures constantly, causing a troublesome operation.

When the ratchet type of socket wrench is operated, it is rotated in a single direction toward a suitable angle, and then it is turned idly to return an original forcing angle, but such a socket wrench has to apply teeth of a head member to retain, therefore its torque output is less than that of the fixed type of socket wrench.

The present invention has arisen to mitigate and/or obviate the afore-described disadvantages.

SUMMARY OF THE INVENTION

The primary object of the present invention is to provide a ratchet wrench of which the head member is capable of being shifted to be positioned and released quickly, and the ratchet wrench allows to obtain stronger torque output and single-direction rotating function, operating the ratchet wrench easily.

To obtain the above objective, a ratchet wrench provided by the present invention contains:

a handle and a head member, wherein the wrench head includes a receiving portion formed in a front end thereof to receive a rotating member and a hole formed therein, and the hole includes a plurality of teeth arranged around an inner peripheral side thereof, and the receiving portion includes a groove disposed on a rear end thereof to communicate with the receiving portion, and the groove includes a through orifice fixed on a bottom end thereof, and the through orifice includes a wider recess formed on a bottom end thereof;

a limiting device secured in the through orifice of the head member and includes a retaining block to be fixed in the groove, and the retaining block includes a post extending downward from a bottom end thereof, and the post includes a notch disposed on a middle section thereof to receive a spring, and the spring includes a sleeve fitted thereon, the post also includes an annular slot formed adjacent to a bottom end thereof to retain with a C-shaped retainer.

DETAILED DESCRIPTION OF THE PREFERRED EMBODIMENTS

Figure 1:
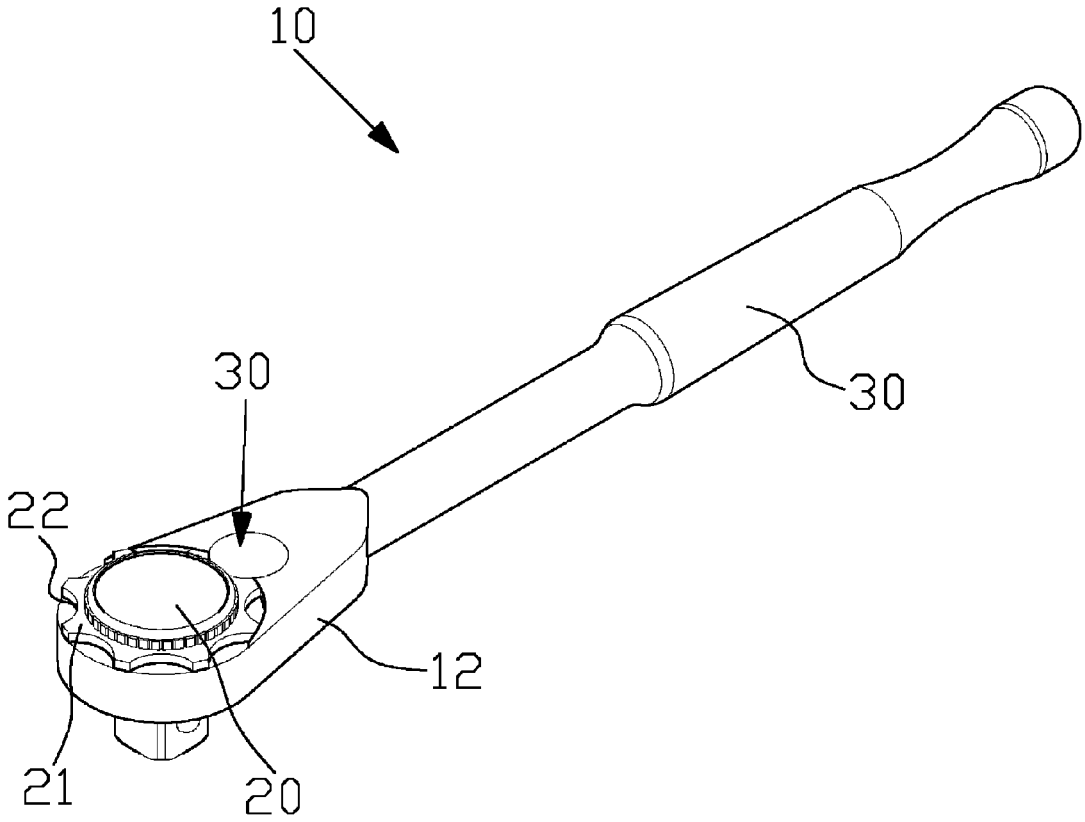
FIG. 1 is a perspective view of the assembly of a ratchet wrench according to a preferred embodiment of the present invention.
Figure 2:
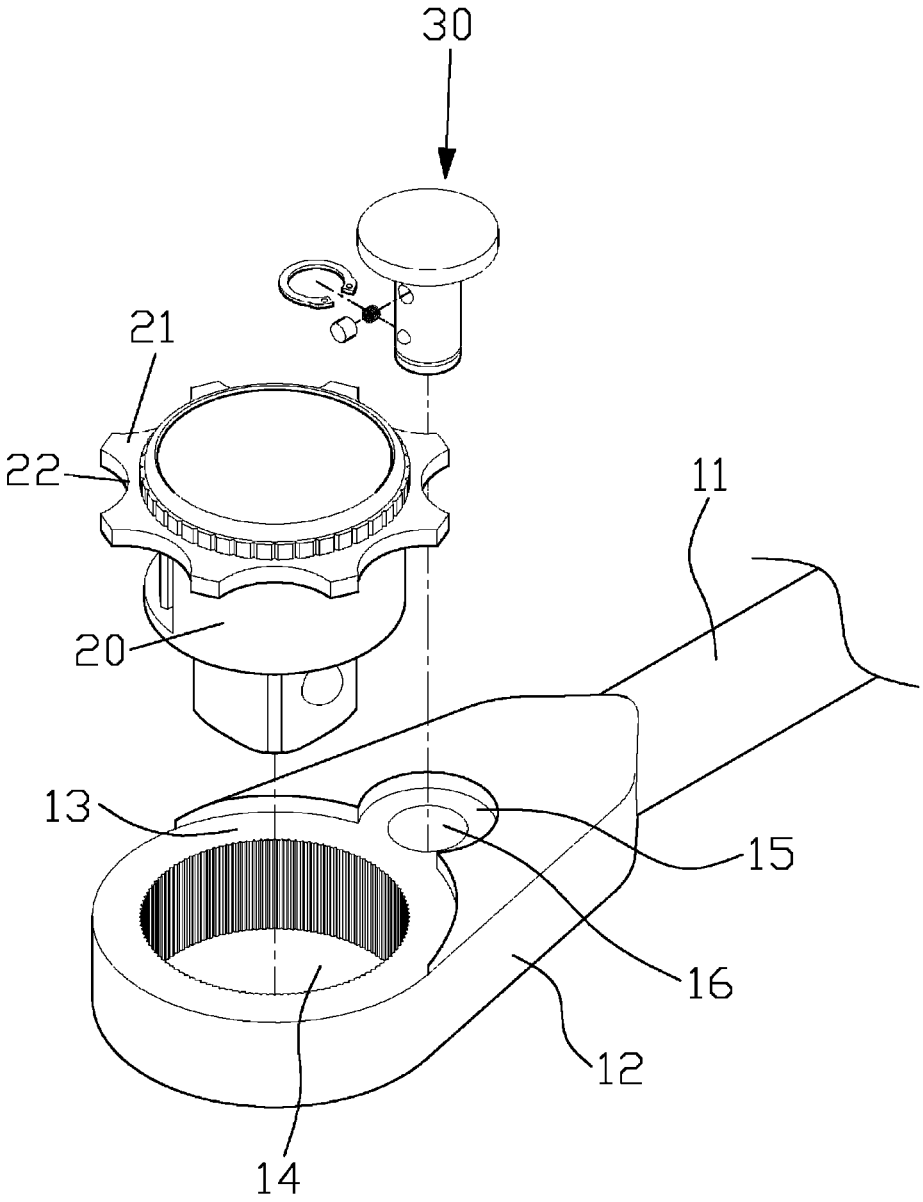
FIG. 2 is a perspective view of the exploded components of a ratchet wrench according to the preferred embodiment of the present invention.
Figure 3:
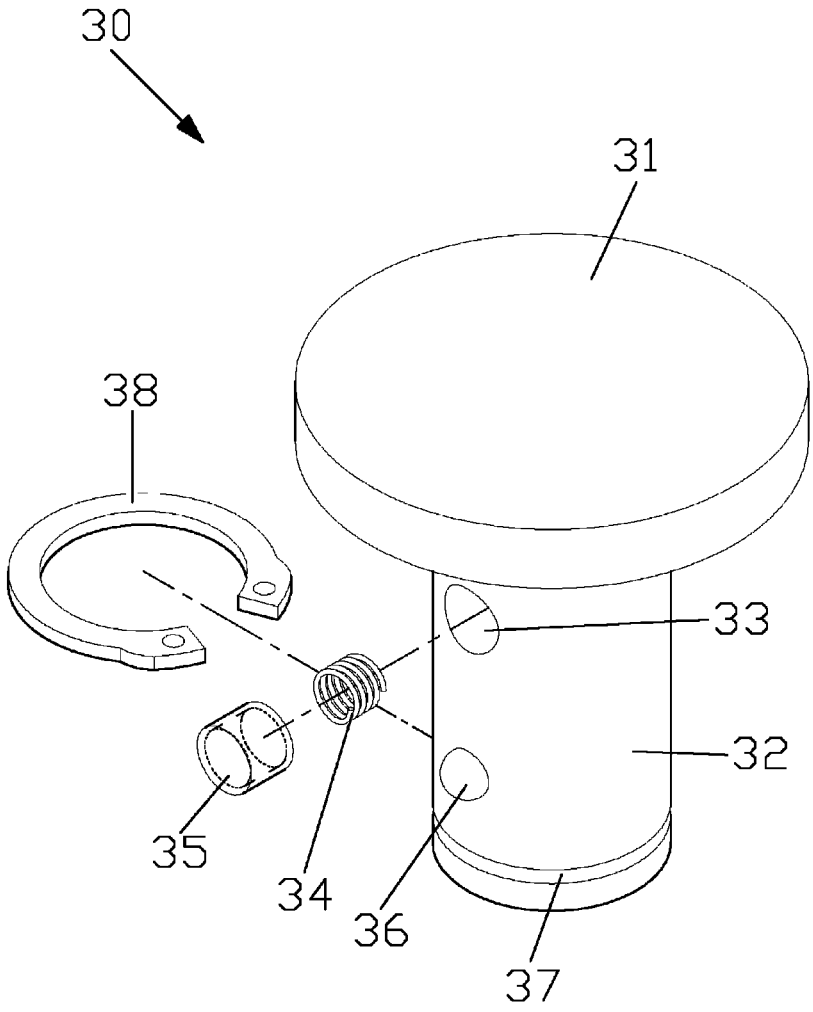
FIG. 3 is a perspective view of the exploded components of a limiting device of the ratchet wrench according to the preferred embodiment of the present invention.

The present invention will be clearer from the following description when viewed together with the accompanying drawings, which show, for purpose of illustrations only, the preferred embodiment in accordance with the present invention.

Referring to FIGS. 1-4, a ratchet wrench 10 in accordance with a preferred embodiment of the present invention comprises a handle 11 and a head member 12, wherein the wrench head 12 includes a receiving portion 13 formed in a front end thereof to receive a rotating member 20 and a hole 14 formed therein, and the hole 14 includes a plurality of teeth arranged around an inner peripheral side thereof, and the receiving portion 13 includes a groove 15 disposed on a rear end thereof to communicate with the receiving portion 13, and the groove 15 includes a through orifice 16 fixed on a bottom end thereof, and the through orifice 16 includes a wider recess 17 formed on a bottom end thereof and a limiting device 30 secured therein.

The limiting device 30 includes a retaining block 31 to be fixed in the groove 15, and the retaining block 31 includes a post 32 extending downward from a bottom end thereof, and the post 32 includes a notch 33 disposed on a middle section thereof to receive a spring 34, and the spring 34 includes a sleeve 35 fitted thereon, the post 32 also includes a ball 36 retained in a lower side thereof and an annular slot 37 formed adjacent to a bottom end thereof to retain with a C-shaped retainer 38.

The rotating member 20 includes a cover piece 21 arranged around a peripheral side thereof, and the cover piece 21 includes a number of cutouts 22 formed around an outer rim thereof, wherein a connecting space between the cutout 22 and the groove 15 is formed to position the retaining block 31 of the limiting device 30.

When the limiting device 30 is received in the through orifice 16, the sleeve 35 pushes the spring 34 outward and retains with an inner wall of the through orifice 16 tightly, the ball 36 is provided to position the limiting device 30, and a diameter of the C-shaped retainers 38 is more than that of the through orifice 16 to prevent the limiting device 30 from disengagement.

Figure 4:
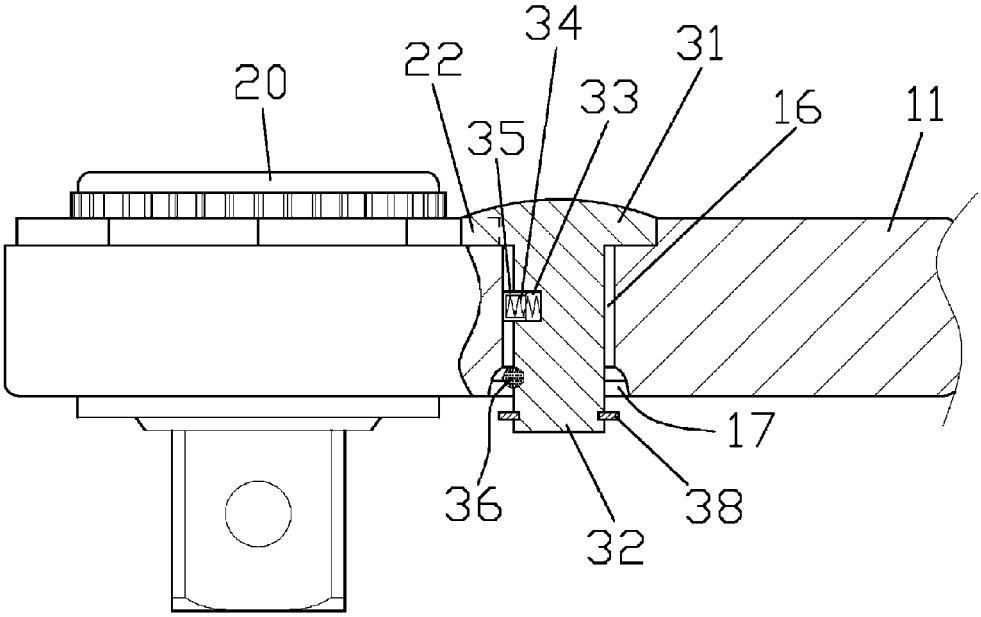
FIG. 4 is a cross sectional view of the operation of the ratchet wrench according to the preferred embodiment of the present invention.

As shown in FIGS. 1 and 4, when the limiting device 30 is pressed downward, the retaining block 31 is fixed in the connecting space between the groove 15 and the cutout 22 to further limit the head member 20 to rotate, thus obtaining a stronger torque output.

Figure 5:
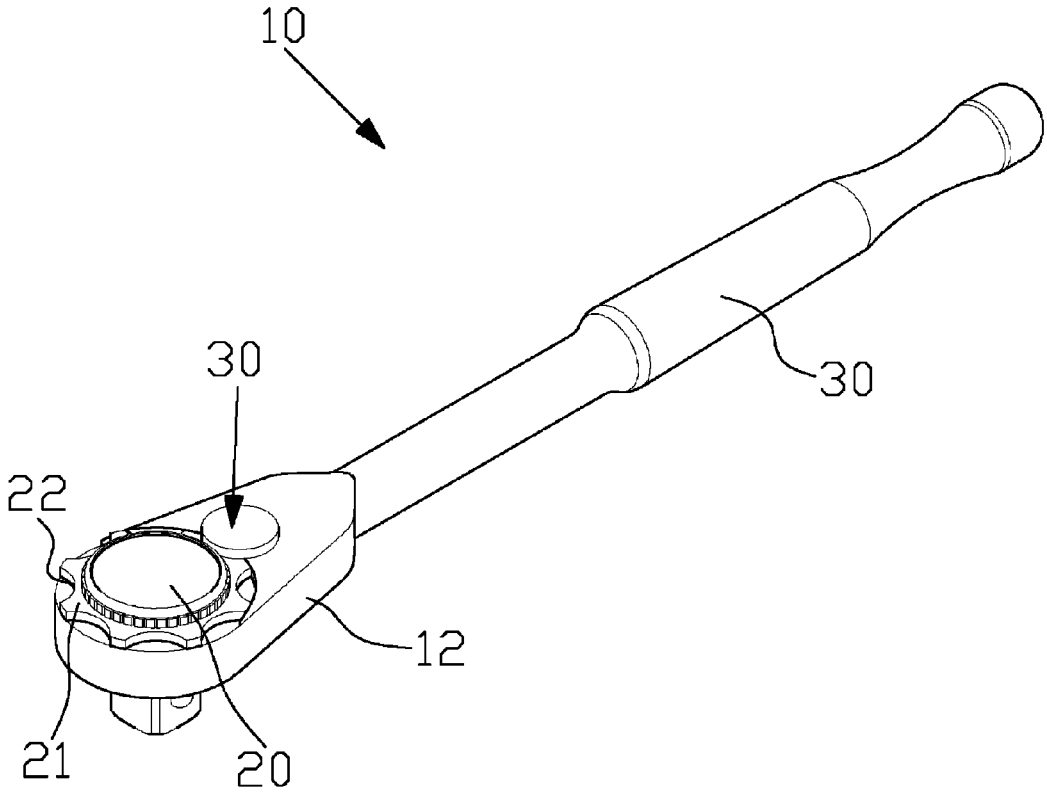
FIG. 5 is a perspective view of the operation of the ratchet wrench according to the preferred embodiment of the present invention.
Figure 6:
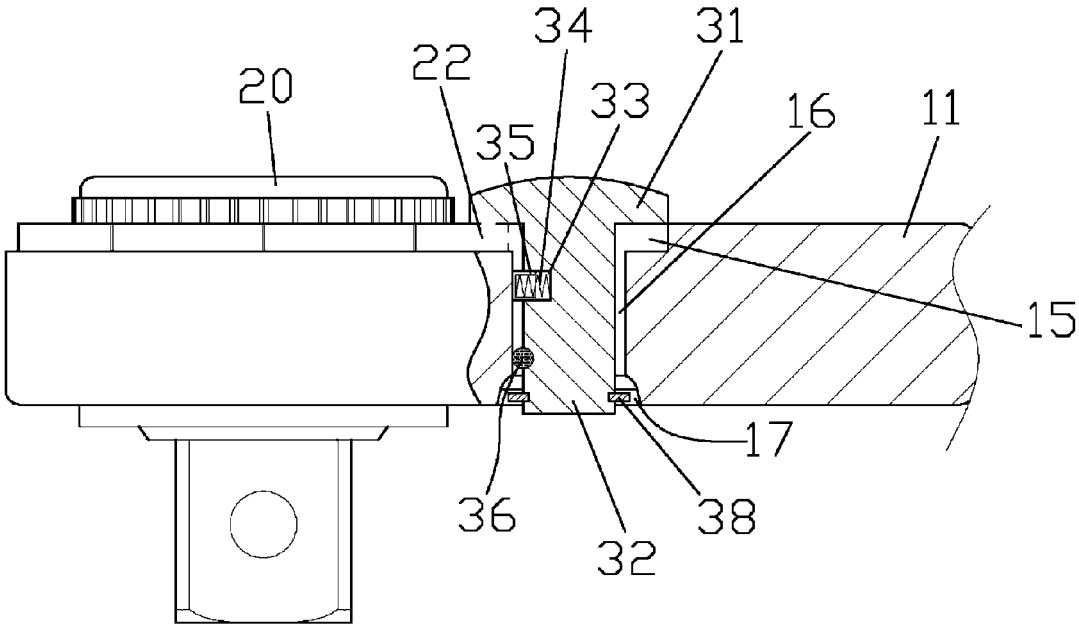
FIG. 6 is a cross sectional view of the operation of the ratchet wrench according to the preferred embodiment of the present invention.

Referring further to FIGS. 5 and 6, when the retaining block 31 is pushed to make the limiting device 30 disengage from the connecting space between the groove 15 and the cutout 22, the cover piece 21 of the head member 20 is released to rotate the ratchet wrench.

Thereby, the head member of the ratchet wrench is capable of being shifted to be positioned and released quickly, and the ratchet wrench allows to obtain stronger torque output and single-direction rotating function, operating the ratchet wrench easily.

While we have shown and described various embodiments in accordance with the present invention, it is clear to those skilled in the art that further embodiments may be made without departing from the scope of the present invention.

What is claimed is:

1. A ratchet wrench comprising:

a handle and a head member, wherein the wrench head includes a receiving portion formed in a front end thereof to receive a rotating member and a hole formed therein, and the hole includes a plurality of teeth arranged around an inner peripheral side thereof, and the receiving portion includes a groove disposed on a rear end thereof to communicate with the receiving portion, and the groove includes a through orifice fixed on a bottom end thereof, and the through orifice includes a wider recess formed on a bottom end thereof;

a rotating member received in said receiving portion, the rotating member including a cover piece arranged around a peripheral side thereof, and the cover piece including a plurality of cutouts formed around an outer rim thereof, wherein a connecting space is formed between the groove and one of said plurality of cutouts;

a limiting device secured in the through orifice of the head member for selectively engaging and disengaging said rotating member, the limiting device including a retaining block to be fixed in the groove, and the retaining block including a post extending in a downward direction from a bottom end thereof, and the post including a notch disposed on a middle section thereof to receive a spring, and the spring including a sleeve fitted thereon, the post also including an annular slot formed adjacent to a bottom end thereof to retain with a C-shaped retainer; and wherein when said limiting device is pressed in said downward direction, said retaining block is fixed in said connecting space to further limit the head member from rotating for a fixed wrench operation obtaining a stronger torque output.

2. The ratchet wrench as claimed in claim 1, wherein the limiting device is received in the through orifice, the sleeve is pushed outward by the spring to retain with an inner wall of the through orifice tightly.

3. The ratchet wrench as claimed in claim 1, wherein a diameter of the C-shaped retainers is more than that of the through orifice to prevent the limiting device from disengagement.

4. The ratchet wrench as claimed in claim 1, wherein the post includes a ball retained in a lower side thereof to position the limiting device.

* * * * *